US009258648B2

(12) United States Patent
Lucas et al.

(10) Patent No.: US 9,258,648 B2
(45) Date of Patent: Feb. 9, 2016

(54) LEVERED LOUDSPEAKERS

(71) Applicant: Bose Corporation, Framingham, MA (US)

(72) Inventors: Brian M. Lucas, Marblehead, MA (US); Johan H. Isaksson, Malmo (SE); Geoffrey C. Chick, Norfolk, MA (US); Benjamin G. K. Peterson, West Boylston, MA (US)

(73) Assignee: Bose Corporation, Framingham, MA (US)

( * ) Notice: Subject to any disclaimer, the term of this patent is extended or adjusted under 35 U.S.C. 154(b) by 59 days.

(21) Appl. No.: 14/200,490

(22) Filed: Mar. 7, 2014

(65) Prior Publication Data

US 2015/0256935 A1 Sep. 10, 2015

(51) Int. Cl.

| | |
|---|---|
| ***H04R 9/00*** | (2006.01) |
| ***H04R 7/00*** | (2006.01) |
| ***H04R 11/02*** | (2006.01) |
| *H04R 9/06* | (2006.01) |

(52) U.S. Cl.

CPC ..... *H04R 7/00* (2013.01); *H04R 11/02* (2013.01); *H04R 9/063* (2013.01); *H04R 2207/00* (2013.01)

(58) Field of Classification Search

CPC ..... H04R 7/00; H04R 9/00; H04R 29/003; H04R 2207/00

See application file for complete search history.

(56) References Cited

U.S. PATENT DOCUMENTS

| | | | | |
|---|---|---|---|---|
| 1,823,512 | A | | 9/1931 | Ringel |
| 1,973,277 | A | | 9/1934 | Barfield |
| 2,035,104 | A | | 3/1936 | Thomas |
| 2,078,469 | A | | 4/1937 | Thomas |
| 2,245,511 | A | | 6/1941 | Turnbull |
| 3,777,078 | A | | 12/1973 | Boutros-Attia et al. |
| 3,836,733 | A | | 9/1974 | Cragg |
| 3,937,904 | A | | 2/1976 | Parker |
| 4,626,717 | A | | 12/1986 | Hensing et al. |
| 5,216,723 | A | | 6/1993 | Froeschle et al. |
| 5,802,189 | A | * | 9/1998 | Blodget ..... 381/162 |
| 6,405,599 | B1 | | 6/2002 | Patt |
| 6,415,037 | B1 | | 7/2002 | Wang |
| 7,247,957 | B2 | | 7/2007 | Dadd |
| 8,139,813 | B2 | | 3/2012 | Kobayashi et al. |
| 2008/0247595 | A1 | | 10/2008 | Henry |
| 2011/0243365 | A1 | | 10/2011 | Carlmark et al. |

(Continued)

FOREIGN PATENT DOCUMENTS

| | | | |
|---|---|---|---|
| CN | 203015064 | U | 6/2013 |
| CN | 203193871 | U | 9/2013 |

(Continued)

OTHER PUBLICATIONS

International Search Report and Written Opinion dated Aug. 4, 2014 for International application No. PCT/US2014/021559.

(Continued)

*Primary Examiner* — Tuan D Nguyen

(57) ABSTRACT

A loudspeaker includes an acoustic diaphragm, an oscillatory force source, a lever that couples the oscillatory force source to the acoustic diaphragm, and a pivot that is coupled to the lever such that the lever pivots about a pivot axis when the oscillatory force source applies a force to the lever. The pivot includes a pair of rotational joints which are spaced apart to allow the diaphragm to pass therebetween as the lever pivots about the pivot axis.

24 Claims, 7 Drawing Sheets

(56) References Cited

U.S. PATENT DOCUMENTS

| | | | | |
|---|---|---|---|---|
| 2011/0243366 | A1 | 10/2011 | Carlmark et al. | |
| 2012/0106772 | A1 | 5/2012 | Horigome et al. | |
| 2012/0248899 | A1 | 10/2012 | Oommen et al. | |
| 2014/0064539 | A1* | 3/2014 | Link et al. | 381/345 |
| 2014/0270328 | A1* | 9/2014 | Lucas et al. | 381/400 |
| 2014/0334662 | A1 | 11/2014 | Lin | |

FOREIGN PATENT DOCUMENTS

| | | | |
|---|---|---|---|
| GB | 212648 | A | 3/1924 |
| GB | 1124830 | A | 8/1968 |
| JP | S6212300 | | 1/1987 |
| JP | 2009225091 | A | 10/2009 |

OTHER PUBLICATIONS

International Search Report and Written Opinion dated Aug. 4, 2014 for International application No. PCT/US2014/021592.
International Search Report and Written Opinion dated Jun. 2, 2015 for International application No. PCT/US2015/018279.
International Search Report and Written Opinion dated May 26, 2015 for International application No. PCT/US2015/018699.
International Search Report and Written Opinion dated May 20, 2015 for International application No. PCT/US2015/018702.
International Search Report and Written Opinion dated May 29, 2015 for International application No. PCT/US2015/018714.
http://bushingsinc.com/index.php/bushings-inc-products-lines/rubber-flex-bushings; retrieved 2007.

* cited by examiner

LEVERED LOUDSPEAKERS

BACKGROUND

This disclosure relates to levered loudspeakers.

SUMMARY

This disclosure is based, at least in part, on the realization that a lever, for a levered loudspeaker, can be configured to provide for a low profile loudspeaker. This disclosure is also based, in part, on the realization that a moving magnet motor for a levered loudspeaker can be configured to reduce magnetic crashing force in the direction parallel to the lever's pivot axis.

In one aspect, a loudspeaker includes an acoustic diaphragm, an oscillatory force source, a lever that couples the oscillatory force source to the acoustic diaphragm, and a pivot that is coupled to the lever such that the lever pivots about a pivot axis when the oscillatory force source applies a force to the lever. The pivot includes a pair of rotational joints which are spaced apart to allow the diaphragm to pass therebetween as the lever pivots about the pivot axis.

Implementations may include one of the following features, or any combination thereof.

In some implementations, the oscillatory force source includes a moving magnet motor. The moving magnet motor includes a permanent magnet that is coupled to the lever, and a stator for creating magnetic flux for the permanent magnet to interact with.

In certain implementations, the moving magnet motor is arranged such that a magnetic crashing force resulting from magnetic attraction between the stator and the permanent magnet is substantially perpendicular to the pivot axis.

In some implementations, the stator defines a curved air gap which accommodates motion of the permanent magnet as the permanent magnet moves in an arcuate path within the air gap.

In certain implementations, the stator includes a pair of cores which define a curved air gap. The permanent magnet is curved.

In some implementations, the loudspeaker includes a connector connecting the diaphragm to the lever. The pivot axis and a connection point where the lever is attached to the connector are arranged in a common plane that is perpendicular to a displacement axis of the acoustic diaphragm when the acoustic diaphragm is in a rest position.

In certain implementations, the loudspeaker includes an enclosure, and a surround that connects the acoustic diaphragm to the enclosure (e.g., directly or via a frame). The rotational joints can be disposed beneath the surround.

In another aspect, a loudspeaker includes an acoustic diaphragm, a first oscillatory force source, and a first lever coupling the first oscillatory force source to the acoustic diaphragm and arranged to pivot about a first pivot axis. The diaphragm passes through the first pivot axis as the first lever pivots about the first pivot axis.

Implementations may include one of the above and/or below features, or any combination thereof.

In some implementations, the loudspeaker also includes a second oscillatory force source, and a second lever coupling the second oscillatory force source to the acoustic diaphragm and arranged such that the second lever pivots about a second pivot axis. The diaphragm passes through the second pivot axis as the second lever pivots about the second pivot axis.

In certain implementations, the loudspeaker also includes a first pivot coupled to the first lever, and a second pivot coupled to the second lever. The first pivot includes a first pair of rotational joints which are spaced apart to allow the diaphragm to pass therebetween as the first lever pivots about the first pivot axis. The second pivot includes a second pair of rotational joints which are spaced apart to allow the diaphragm to pass therebetween as the second lever pivots about the second pivot axis.

In some implementations, the first and second levers are configured and arranged for rotation in opposite directions relative to each other.

In certain implementations, the first and second oscillatory force sources each include a respective moving magnet motor. Each of the moving magnet motors include a permanent magnet, and a stator for creating magnetic flux for the permanent magnet to interact with. The moving magnet motors are arranged such that magnetic crashing forces resulting from magnetic attraction between the stators and the permanent magnets are substantially perpendicular to the first and second pivot axes.

In some implementations, the first oscillatory force source includes a moving magnet motor. The moving magnet motor includes a permanent magnet, and a stator for creating magnetic flux for the permanent magnet to interact with. The moving magnet motor is arranged such that a magnetic crashing force resulting from magnetic attraction between the stator and the permanent magnet is substantially perpendicular to the first pivot axis.

In certain implementations, the stator defines a curved air gap which accommodates motion of the permanent magnet as the permanent magnet moves in an arcuate path within the air gap.

In some implementations, the stator includes a pair of cores which define a curved air gap, and the permanent magnet is curved.

Another aspect features a loudspeaker that includes an acoustic diaphragm, a first oscillatory force source, and a first lever coupling the first oscillatory force source to the acoustic diaphragm and arranged such that the first lever pivots about a first pivot axis when the first oscillatory force source applies a force to the first lever. The first lever includes a first lever arm extending between the first pivot axis and the acoustic diaphragm and arranged to move in phase with the acoustic diaphragm, and a first pair of support arms disposed between the first pivot axis and the first oscillatory force source and arranged to move out of phase with the acoustic diaphragm. The first pair of support arms being spaced apart to allow the acoustic diaphragm to pass therebetween as the first lever pivots about the pivot axis.

Implementations may include one of the above and/or below features, or any combination thereof.

In some implementations, the diaphragm passes through the first pivot axis as the first lever pivots about the first pivot axis.

In certain implementations, the loudspeaker includes an enclosure, a surround connecting the acoustic diaphragm to the enclosure (e.g., directly or via a frame), and a first pair of rotational joints pivotally coupling the first lever to the enclosure. The first pair of rotational joints are spaced apart to allow the diaphragm to pass therebetween as the first lever pivots about the first pivot axis.

In some implementations, the first oscillatory force source includes a moving magnet motor that includes a permanent magnet, and a stator for creating magnetic flux for the permanent magnet to interact with. The first lever couples the permanent magnet and the acoustic diaphragm and is configured such that motion of the permanent magnet causes the first lever to pivot about the first pivot axis.

In certain implementations, the loudspeaker includes a second oscillatory force source, and a second lever coupling the second oscillatory force source to the acoustic diaphragm and arranged such that the second lever pivots about a second pivot axis when the second oscillatory force source applies a force to the second lever. The second lever includes a second lever arm extending between the second pivot axis and the acoustic diaphragm and arranged to move in phase with the acoustic diaphragm, and a second pair of support arms disposed between the second pivot axis and the second oscillatory force source and arranged to move out of phase with the acoustic diaphragm, the second pair of support arms being spaced apart to allow the acoustic diaphragm to pass therebetween as the second lever pivots about the second pivot axis.

In yet another aspect, a loudspeaker includes an acoustic diaphragm and a moving magnet motor. The moving magnet motor includes a permanent magnet, and a stator for creating magnetic flux for the permanent magnet to interact with. The loudspeaker also includes a lever coupling the permanent magnet and the acoustic diaphragm and configured such that motion of the permanent magnet causes the lever to pivot about a pivot axis. The moving magnet motor is arranged such that a magnetic crashing forces resulting from magnetic attraction between the stator and the permanent magnet is substantially perpendicular to the pivot axis.

Implementations may include one of the above features, or any combination thereof.

Another aspect provides a loudspeaker that includes an acoustic diaphragm, a first moving magnet motor, a second moving magnet motor, a first lever coupling the first moving magnet motor to the acoustic diaphragm and arranged such that the first lever pivots about a first pivot axis when the first moving magnet motor applies a force to the first lever, and a second lever coupling the second moving magnet motor to the acoustic diaphragm and arranged such that the second lever pivots about a second pivot axis when the second moving magnet motor applies a force to the second lever. Each of the first and second moving magnet motors includes a permanent magnet, and a stator for creating magnetic flux for the permanent magnet to interact with. The first and second moving magnet motors are arranged such that magnetic crashing forces resulting from magnetic attraction between the stators and the permanent magnets are substantially perpendicular to the first and second pivot axes.

Implementations may include one of the above features, or any combination thereof.

All examples and features mentioned above can be combined in any technically possible way. Other features and advantages will be apparent from the description and the claims.

DETAILED DESCRIPTION

Figure 1A:
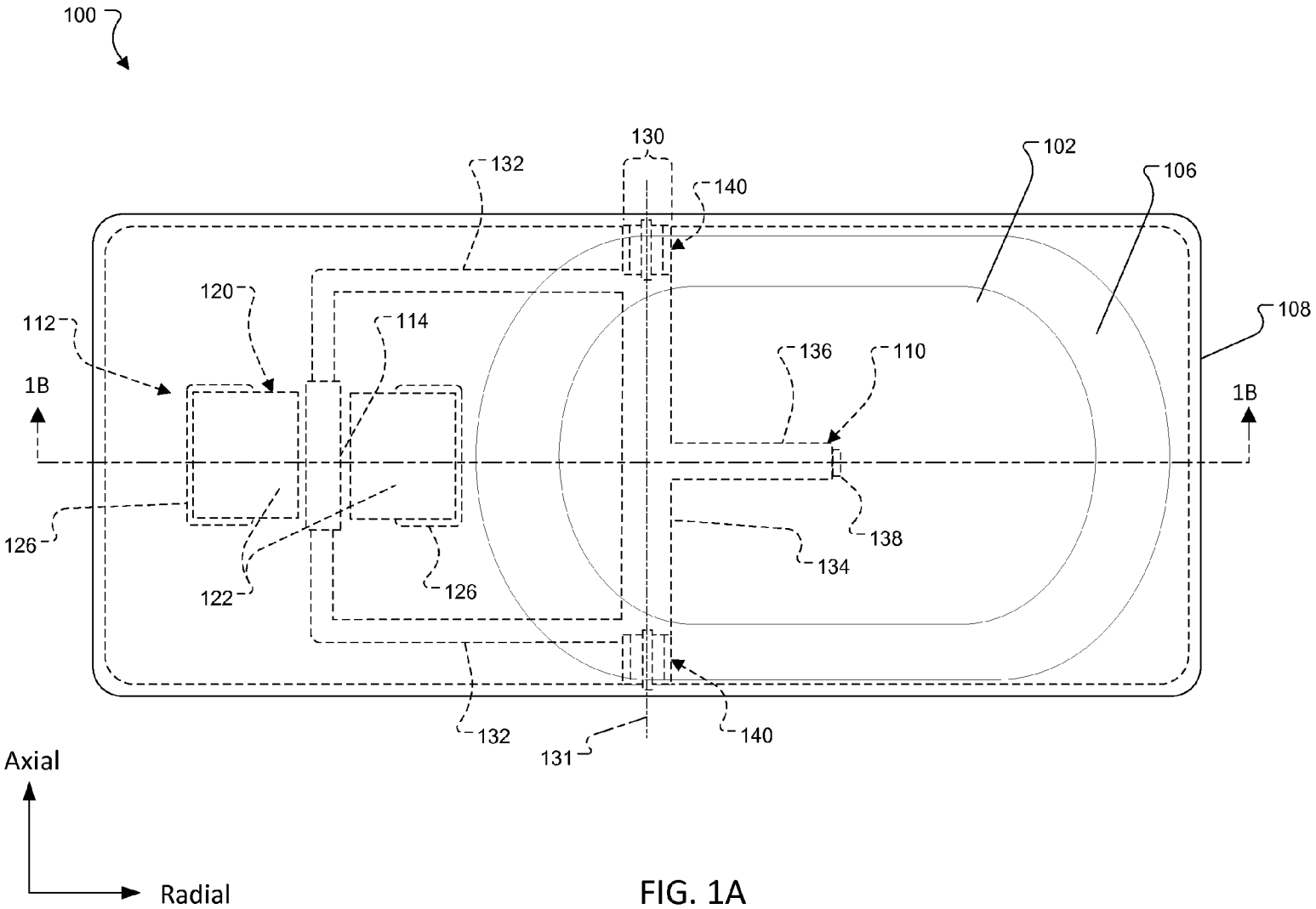
FIG. 1A is a top plan view of a loudspeaker that employs a lever which drives an acoustic diaphragm.
Figure 1B:
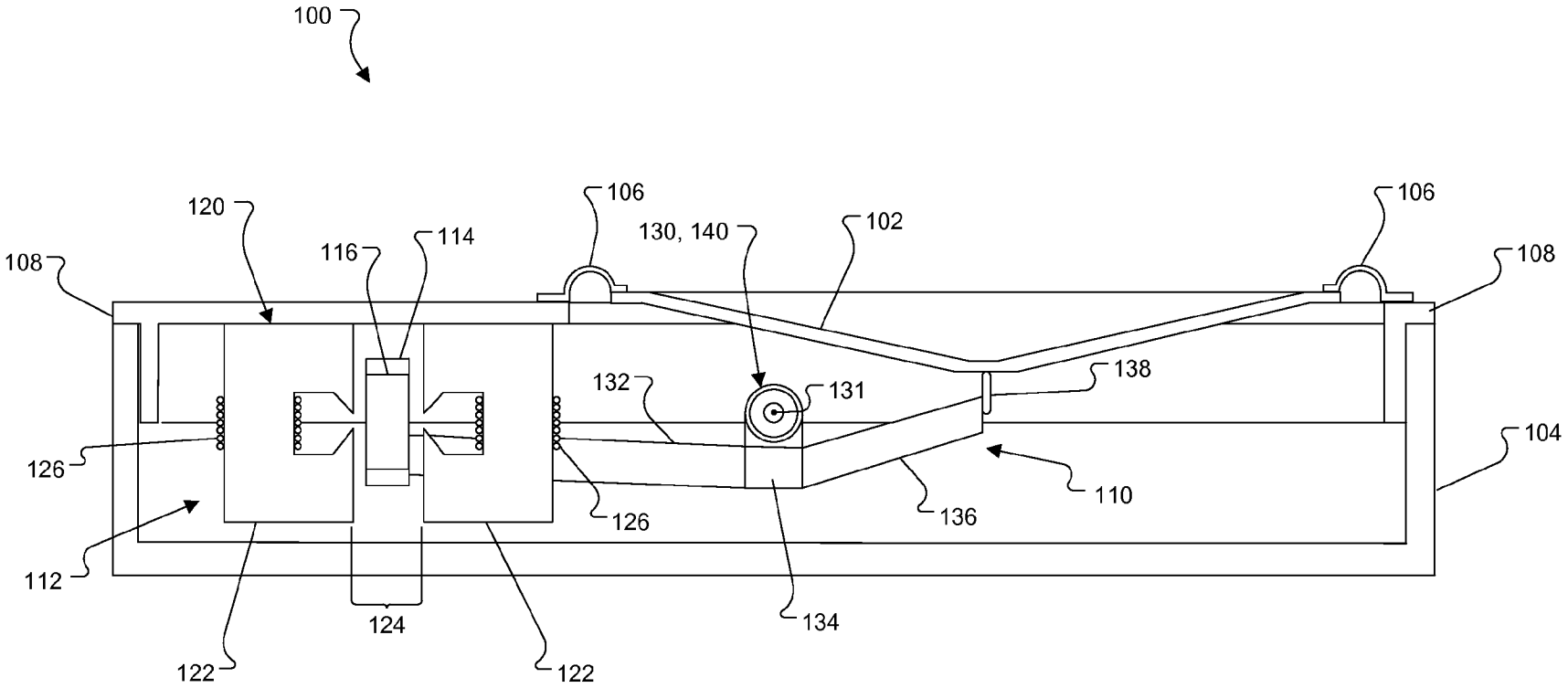
FIG. 1B is a cross-sectional side view of the loudspeaker of FIG. 1A, taken along line 1B-1B.

Referring to FIGS. 1A and 1B, a loudspeaker 100 includes an acoustic diaphragm 102 (e.g., a cone type speaker diaphragm, also known simply as a "cone") that is mounted to an enclosure 104, which may be metal, plastic, or other suitable material, by a surround 106. For example, in some instances the surround 106 is mounted to a frame 108 and the frame 108 is connected to the enclosure 104. The loudspeaker 100 includes a lever 110 that is mechanically connected at one point along the lever 110 to the acoustic diaphragm 102 and at another point along the lever 110 to an oscillatory force source 112.

In the illustrated example, the oscillatory force source 112 includes a substantially planar armature 114 that is attached to the lever 110. The armature 114 includes one or more permanent magnets 116 (one shown). The armature 114 and the lever 110 may be part of one unitary structure. The oscillatory force source 112 also includes a stator 120, which provides a magnetic flux for the one or more permanent magnets 116 to interact with, thereby to drive motion of the acoustic diaphragm.

The stator 120 includes one or more cores 122 (two shown) which define an air gap 124. The cores 122 are formed of high magnetic permeability material around which coils 126 are wound. The lever 110 is positioned such that the armature 114 is in the air gap 124 and electrical current is passed through the coils 126 so that that the combination of the armature 114, the cores 122, and the coils 126 form a moving magnet motor. In this arrangement, the force results from the interaction of the magnetic field in the gap 124 due to the current flowing in the coils 126 and the magnetic field of the permanent magnet 116, so the force is applied to the lever 110 in a non-contact manner.

The lever 110 is pivotally connected to a mechanical ground reference, such as the enclosure 104 (e.g., via the frame 108) of the loudspeaker 100, at a pivot 130 such that the lever 110 moves in an arcuate path about a pivot axis 131. The lever 110 includes one or more support arms 132 (two shown) that are fixed to the pivot 130 and support the armature 114. A cross-member 134 connects the support arms 132 to a lever arm 136. The lever arm 136 is connected to the acoustic diaphragm 102 via a connector 138, such as a hinge, which allows the lever 110 to move relative to the acoustic diaphragm 102, thereby to allow the acoustic diaphragm 102 to move in a pistonic motion, rather than following the arcuate path of the lever 110.

Notably, the shape of the lever 110 and the pivot 130 allows the excursion of the acoustic diaphragm 102 to be maximized without interfering with the lever 110. The portion of the lever 110 that moves out of phase with the acoustic diaphragm 102 is positioned outside of the footprint of the acoustic diaphragm 102. For example, in the illustrated implementation, the support arms 132 are spaced apart and positioned outside of the outer diameter of the acoustic diaphragm 102 which allows the acoustic diaphragm 102 to pass between the support arms 132 as the lever 110 pivots about the pivot axis 131. This can help to reduce the overall height of the loudspeaker 102 since additional clearance beneath the acoustic diaphragm 102 is not needed to accommodate the motion of the support arms 132 during the displacement of the acoustic diaphragm 102, as would be the case if the support arms 132 were instead positioned directly within the path of motion of the acoustic diaphragm 102.

The pivot 130 includes a pair of rotational joints 140 which are connected to each other via the cross-member 134 of the lever 110. In some implementations, the rotational joints 140 may be bushings, e.g., elastomeric torsion bushings such as described in in U.S. patent application Ser. No. 14/200,614, filed concurrently herewith, entitled "Elastomeric Torsion Bushings for Levered Loudspeakers", inventors: Brian M. Lucas et al., the entire contents of which are hereby incorporated by reference. The rotational joints 140 can be positioned beneath the surround 106 which can help to minimize package width (i.e., by not adding to the width with the inclusion of the rotational joints), and it can also allow the rotational joints 140 to be raised up to help minimize relative lateral motion between the acoustic diaphragm 102 and the connection point of the lever 110.

It can be beneficial to have the pivot axis 131 and the point where the lever 110 is attached to the connector 138 arranged in or near a common plane that is parallel to acoustic diaphragm 102 (i.e., perpendicular to the axis of displacement of the diaphragm) when the diaphragm 102 is in the rest (i.e., neutral displacement) position. Moving the rotational joints 140, and, as a result, the pivot axis 131, up closer to the horizontal plane in which the point 142 where the lever 110 is attached to the connector 138 resides reduces the relative lateral motion between the acoustic diaphragm 102 and the connection point of the lever 100 for a given diaphragm displacement.

Figure 2:
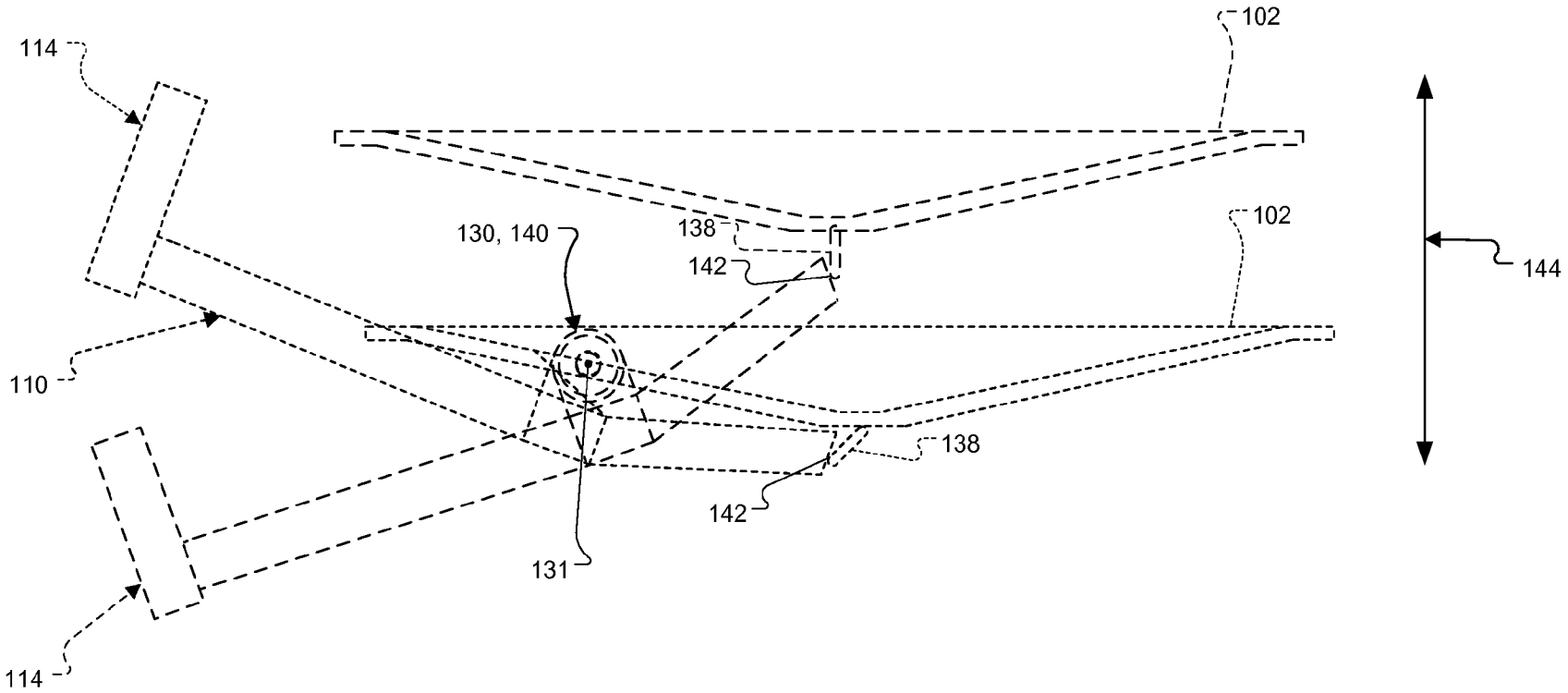
FIG. 2 illustrates oscillatory, arcuate movement of the lever and pistonic movement of an acoustic diaphragm of the loudspeaker of FIG. 1A.

Referring now to FIG. 2, the lever 110, in combination with the interaction between the armature 114 and the stator 120 (not shown in FIG. 2), moves the acoustic diaphragm 102 in a pistonic motion (as indicated by arrow 144). Notably, the rotational joints 140 are spaced apart from each other and the cross-member 134 (FIG. 1A) is offset from the rotational joints 140 such that the acoustic diaphragm 102 is free to move therebetween, e.g., during a retraction (downward movement), and such that the acoustic diaphragm 102 passes through the pivot axis 131 as the lever 110 pivots about the pivot axis 131.

Moving magnet motors can be subject to a magnetic crashing force which results from magnetic attraction between the stator 120 and armature 114. The crashing force varies as a function of the distance between the armature 114 and the cores 122; the closer the permanent magnet 116 is to the cores 122, the stronger the magnetic crashing force. It may be convenient to think of the structure as requiring a crashing stiffness that inhibits the armature 114 from crashing into the cores 122.

In the implementation illustrated in FIGS. 1A, 1B, and 2, the moving magnet motor is arranged such that a magnetic crashing force resulting from interaction between the stator and the one or more permanent magnets 116 are substantially in the radial direction with respect to the pivot axis 131 (i.e., such that the magnetic crashing force is substantially perpendicular to the pivot axis). This can eliminate the need to utilize rotational joints that are axially stiff (i.e., stiff in the axial direction with respect to the pivot axis 131).

Other Implementations

Figure 3A:
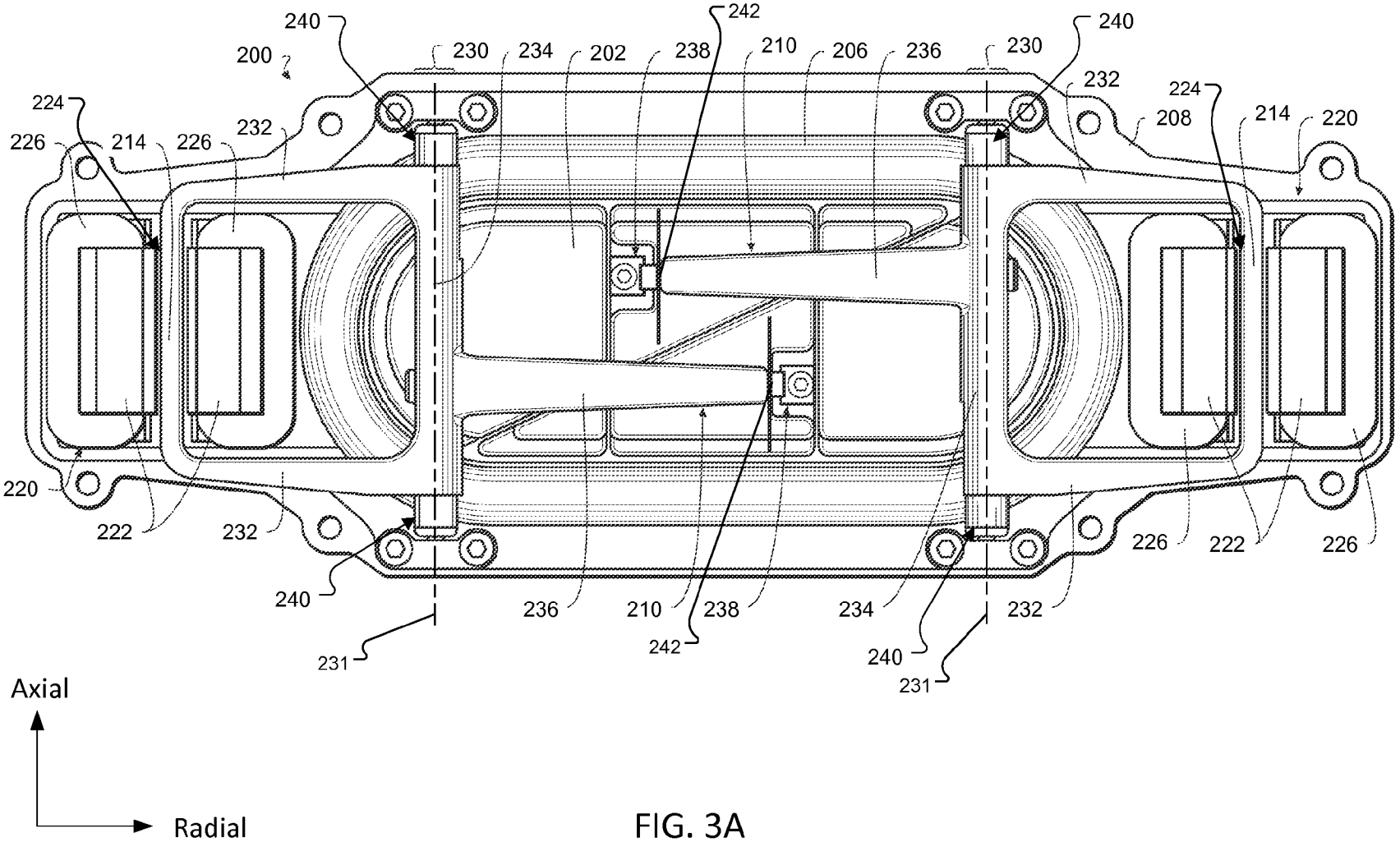
FIGS. 3A and 3B are bottom plan and perspective views, respectively, of a multi-lever loudspeaker
Figure 3B:
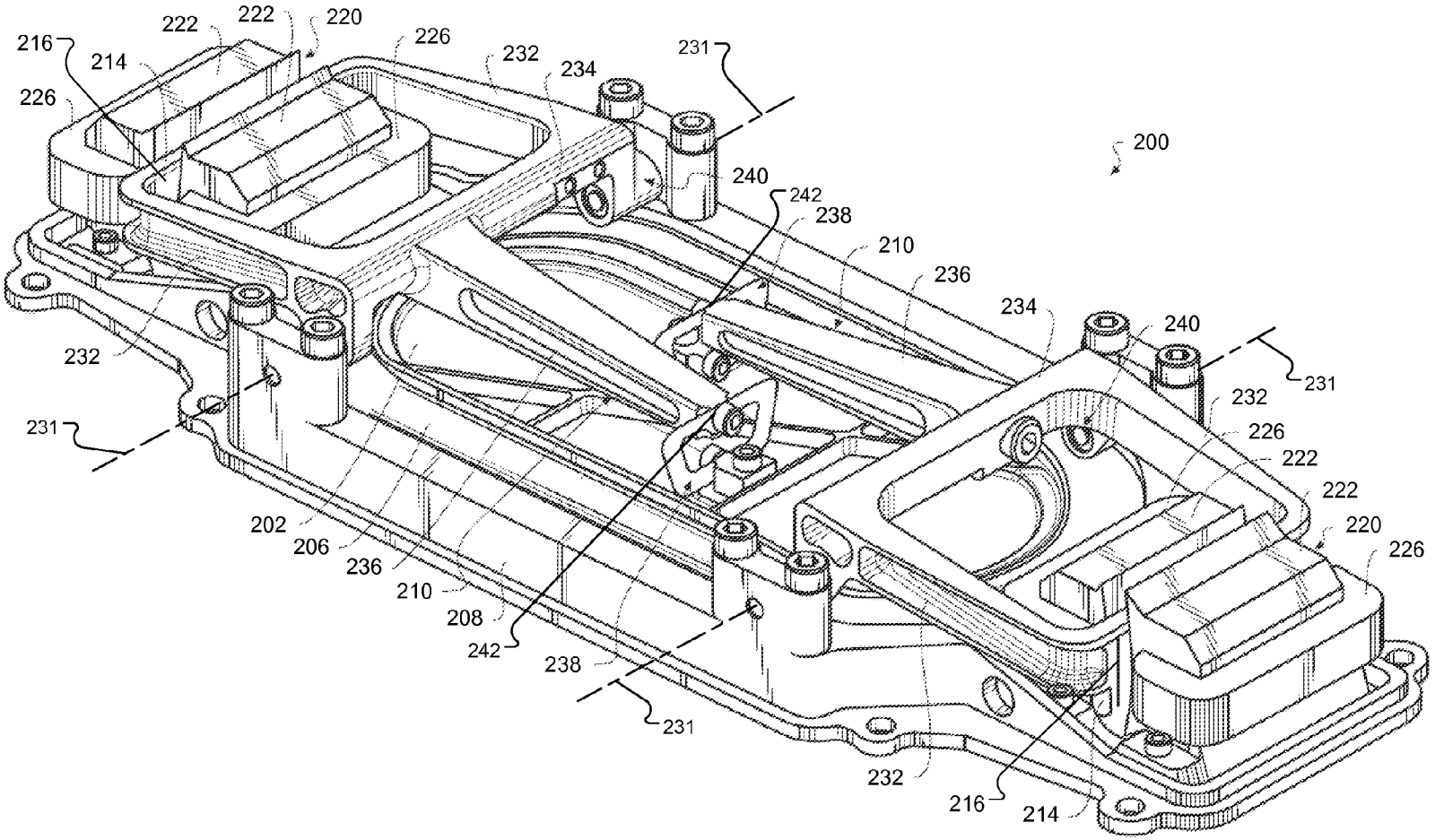

Although implementations have been described which include a single lever for driving motion of an acoustic diaphragm, multi-lever configurations are also possible. For example, FIGS. 3A and 3B illustrate an implementation of a loudspeaker that includes plural levers 210 (two shown). In the illustrated example, an acoustic diaphragm 202 is mounted to an enclosure (not shown) by a surround 206. The surround 206 is mounted to a frame 208 and the frame 208 is connected to the enclosure.

In the illustrated example, the levers 210 are arranged for rotation in opposite directions relative to each other. The levers 210 are pivotally connected to a mechanical ground reference, such as the enclosure or the frame 208 of the loudspeaker 100, at respective pivots 230 such that each of the levers 210 moves in an arcuate path about the respective pivot axis 231. The pivot axes 231 are arranged inboard of a pair of armatures 214, each of the armatures 214 being associated with a corresponding one of the levers 210. The levers 210 couple the armatures 214 to the acoustic diaphragm 202 for transmitting motions of the armatures 214 to the acoustic diaphragm 202.

Each of the armatures 212 includes a permanent magnet 216 (FIG. 3B), and each armature 214 is driven by an associated stator 220. The stators 220 provide magnetic flux for the permanent magnets 216 to interact with, thereby to drive motion of the acoustic diaphragm 202. Each of the stators 220 includes a pair of cores 222, which together define an air gap 224 (FIG. 3B) within which an associated one of the armatures 214 is disposed. The cores 222 can be secured to the frame 208 (e.g., with an adhesive).

Each core 222 includes a coil 226 of electrically conductive material wound about it. Current in coils 226 produce magnetic flux across the air gaps 224. The magnetic flux interacts with the permanent magnets 216 of the armatures 214 to drive the motion of the acoustic diaphragm 202.

Each lever 210 includes one or more support arms 232 (two shown) that support the armature 214. A cross-member 234 connects the support arms 232 to a lever arm 236. Each lever arm 236 is connected to the acoustic diaphragm 202 via connector 238 (FIG. 3B), such as a hinge or flexure, which allows the levers 210 to move relative to the acoustic diaphragm 202, thereby to allow the acoustic diaphragm 202 to move in a pistonic motion, rather than following the arcuate path of the levers 210.

Notably, the shape of the levers 210 and the pivots 230 allows the excursion of the acoustic diaphragm 202 to be maximized without interfering with the levers 210. The portions of the levers 210 that move out of phase with the acoustic diaphragm 202 are positioned outside of the footprint of the acoustic diaphragm 202. For example, in the illustrated implementation, the support arms 232 are spaced apart and positioned outside of the outer diameter of the acoustic diaphragm 202 which allows the acoustic diaphragm 202 to pass between the support arms 232 as the levers 210 pivot about their respective pivot axes 231. This can help to reduce the overall height of the loudspeaker 200 since additional clearance beneath the acoustic diaphragm 202 is not needed to accommodate the motion of the support arms 232 during the displacement of the acoustic diaphragm 202, as would be the case if the support arms 232 were instead positioned directly within the path of motion of the acoustic diaphragm 202.

The pivots 230 each include a pair of rotational joints 240 (e.g., bushings) which are connected to each other via the cross-member 234 of the lever 210. The rotational joints 240 can be positioned beneath the surround 206 which can help to minimize package width (i.e., by not adding to the width with the inclusion of the rotational joints), and it can also allow the rotational joints to be raised up to help minimize relative lateral motion between the acoustic diaphragm 202 and the connection point of the lever 210. In the illustrated example, the rotational joints 240 are spaced apart and raised up such that the acoustic diaphragm 202 passes through the pivot axes 231 as the levers 210 pivot about their respective pivot axes 231.

In some cases, the pivot axes 231 and the points 242 where the levers 210 are attached to the connectors 238 are arranged in or near a common plane that is parallel to the acoustic diaphragm 202 (i.e., perpendicular to the axis of displacement of the acoustic diaphragm) when the acoustic diaphragm 202 is in the rest (i.e., neutral displacement) position. Moving the rotational joints 240, and, as a result, the pivot axes 231, up closer to the horizontal plane in which the points 242 where the levers 210 are attached to the connectors 238 reside reduces the relative lateral motion between the acoustic diaphragm 202 and the points 242 where the levers 210 connect to the connectors 238.

In the implementation illustrated in FIGS. 3A and 3B, the moving magnet motors are arranged such that magnetic crashing forces resulting from interaction between the stators and the permanent magnets 216 are substantially in the radial direction with respect to the axis of rotation of the respective levers (i.e., such that the magnetic crashing forces are substantially perpendicular to the pivot axes of the levers).

Figure 4:
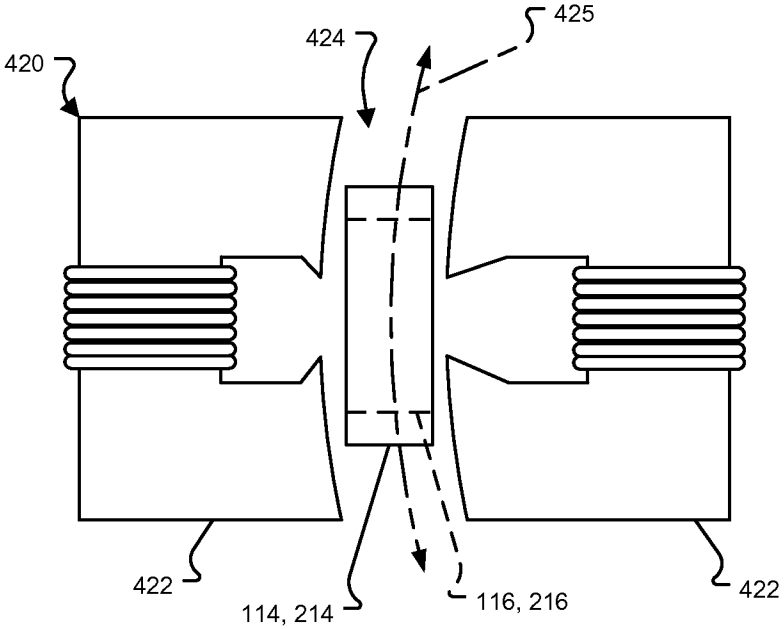
FIG. 4 is a side view of an alternative configuration for a moving magnet motor, suitable for use with the loudspeakers of FIGS. 1A and 3A, which includes a stator with a curved air gap.

FIG. 4 illustrates another implementation of a moving magnet motor that can be utilized in a loudspeaker, such as those described above with respect to FIGS. 1A through 3B. Notably, in the moving magnet motor of FIG. 4, the stator 420 includes one or more cores 422 (two shown) that define a curved air gap 424. Having a curved air gap 424 can help to accommodate the arcuate motion (arrow 425) of the armature 114, 214 and magnet 116, 216 and can allow the air gap 424 to be narrower. A narrower air gap 424 can help to improve the magnetic flux density within the air gap 424 and thus can improve the efficiency of the moving magnet motor.

Figure 5:
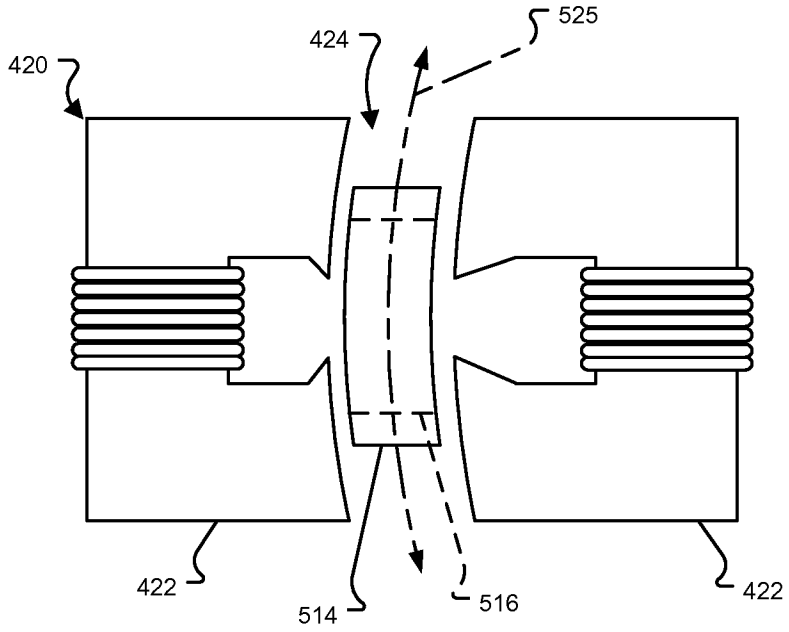
FIG. 5 is a side view of another alternative configuration for a moving magnet motor, suitable for use with the loudspeakers of FIGS. 1A and 3A, which includes a stator with a curved air gap and a curved armature and permanent magnet.

FIG. 5 illustrates another implementation of a moving magnet motor in which a curved armature 514 supporting one or more curved permanent magnet 516 (one shown) are utilized with the stator 420 of FIG. 4. Such a configuration can allow for an even narrower air gap 424 as compared to configurations which utilize a rectangular armature and magnet. As in the above examples, the armature 514 may be formed integrally with a lever (such as lever 110, FIG. 1A or levers 210, FIG. 3A).

A number of implementations have been described. Nevertheless, it will be understood that additional modifications may be made without departing from the scope of the inventive concepts described herein, and, accordingly, other embodiments are within the scope of the following claims.

What is claimed is:

1. A loudspeaker comprising:
an acoustic diaphragm;
an oscillatory force source;
a lever coupling the oscillatory force source to the acoustic diaphragm; and
a pivot coupled to the lever such that the lever pivots about a pivot axis when the oscillatory force source applies a force to the lever,
wherein the pivot comprises a pair of rotational joints which are spaced apart to allow the diaphragm to pass therebetween as the lever pivots about the pivot axis.

2. The loudspeaker of claim 1, wherein the oscillatory force source comprises a moving magnet motor comprising:
a permanent magnet coupled to the lever; and
a stator for creating magnetic flux for the permanent magnet to interact with.

3. The loudspeaker of claim 2, wherein the moving magnet motor is arranged such that a magnetic crashing force resulting from magnetic attraction between the stator and the permanent magnet is substantially perpendicular to the pivot axis.

4. The loudspeaker of claim 2, wherein the stator defines a curved air gap which accommodates motion of the permanent magnet as the permanent magnet moves in an arcuate path within the air gap.

5. The loudspeaker of claim 2, wherein the stator comprises a pair of cores which define a curved air gap, and wherein the permanent magnet is curved.

6. The loudspeaker of claim 2, further comprising a connector connecting the diaphragm to the lever,
wherein the pivot axis and a connection point where the lever is attached to the connector are arranged in a common plane that is perpendicular to a displacement axis of the acoustic diaphragm when the acoustic diaphragm is in a rest position.

7. The loudspeaker of claim 1, further comprising:
an enclosure; and
a surround connecting the acoustic diaphragm to the enclosure; and
wherein the rotational joints are disposed beneath the surround.

8. A loudspeaker comprising: an acoustic diaphragm; a first oscillatory force source; and a first lever coupling the first oscillatory force source to the acoustic diaphragm and arranged such that the first lever pivots about a first pivot axis, wherein the diaphragm intersects the first pivot axis as the first lever pivots about the first pivot axis.

9. The loudspeaker of claim 8, further comprising:
a second oscillatory force source; and
a second lever coupling the second oscillatory force source to the acoustic diaphragm and arranged such that the second lever pivots about a second pivot axis,
wherein the diaphragm passes through the second pivot axes as the second lever pivots about the second pivot axis.

10. The loudspeaker of claim 9, further comprising:
a first pivot coupled to the first lever; and
a second pivot coupled to the second lever,
wherein the first pivot comprises a first pair of rotational joints which are spaced apart to allow the diaphragm to pass therebetween as the first lever pivots about the first pivot axis, and
wherein the second pivot comprises a second pair of rotational joints which are spaced apart to allow the diaphragm to pass therebetween as the second lever pivots about the second pivot axis.

11. The loudspeaker of claim 9, wherein the first and second levers are configured and arranged for rotation in opposite directions relative to each other.

12. The loudspeaker of claim 9, wherein the first and second oscillatory force sources each comprise a respective moving magnet motor, each of the moving magnet motors comprising:
a permanent magnet; and
a stator for creating magnetic flux for the permanent magnet to interact with,
wherein the moving magnet motors are arranged such that magnetic crashing forces resulting from magnetic attraction between the stators and the permanent magnets are substantially perpendicular to the first and second pivot axes.

13. The loudspeaker of claim 8, wherein the first oscillatory force source comprises a moving magnet motor comprising:
a permanent magnet; and a stator for creating magnetic flux for the permanent magnet to interact with, wherein the moving magnet motor is arranged such that a magnetic crashing force resulting from magnetic attraction between the stator and the permanent magnet is substantially perpendicular to the first pivot axis.

14. The loudspeaker of claim 13, wherein the stator defines a curved air gap which accommodates motion of the permanent magnet as the permanent magnet moves in an arcuate path within the air gap.

15. The loudspeaker of claim 13, wherein the stator comprises a pair of cores which define a curved air gap, and wherein the permanent magnet is curved.

16. A loudspeaker comprising:

an acoustic diaphragm;

a first oscillatory force source;

a first lever coupling the first oscillatory force source to the acoustic diaphragm and arranged such that the first lever pivots about a first pivot axis when the first oscillatory force source applies a force to the first lever; and wherein the first lever comprises:

a first lever arm extending between the first pivot axis and the acoustic diaphragm and arranged to move in phase with the acoustic diaphragm; and a first pair of support arms disposed between the first pivot axis and the first oscillatory force source and arranged to move out of phase with the acoustic diaphragm, the first pair of support arms being spaced apart to allow the acoustic diaphragm to pass therebetween as the first lever pivots about the pivot axis.

17. The loudspeaker of claim 16, wherein the diaphragm passes through the first pivot axis as the first lever pivots about the first pivot axis.

18. The loudspeaker of claim 16, further comprising:

an enclosure;

a surround connecting the acoustic diaphragm to the enclosure; and a first pair of rotational joints pivotally coupling the first lever to the enclosure, wherein the first pair of rotational joints are spaced apart to allow the diaphragm to pass therebetween as the first lever pivots about the first pivot axis.

19. The loudspeaker of claim 16, further comprising:

an enclosure;

a surround connecting the acoustic diaphragm to the enclosure; and a first pair of rotational joints pivotally coupling the first lever to the enclosure, wherein first pair of rotational joints are disposed beneath the surround.

20. The loudspeaker of claim 16, wherein the first oscillatory force source comprises a moving magnet motor comprising:

a permanent magnet, and a stator for creating magnetic flux for the permanent magnet to interact with, wherein the first lever couples the permanent magnet and the acoustic diaphragm and is configured such that motion of the permanent magnet causes the first lever to pivot about the first pivot axis.

21. The loudspeaker of claim 20, wherein the moving magnet motor is arranged such that a magnetic crashing force resulting from magnetic attraction between the stator and the permanent magnet is substantially perpendicular to the first pivot axis.

22. The loudspeaker of claim 20, wherein the stator defines a curved air gap which accommodates motion of the permanent magnet as the permanent magnet moves in an arcuate path within the air gap.

23. The loudspeaker of claim 20, wherein the stator comprises a pair of cores which define a curved air gap, and wherein the permanent magnet is curved.

24. The loudspeaker of claim 16, further comprising a connector connecting the first lever to the acoustic diaphragm, wherein the first pivot axis and a point where the first lever is connected to the connector are arranged in a common plane that is perpendicular to a displacement axis of the acoustic diaphragm when the acoustic diaphragm is in a rest position.

* * * * *